US007164385B2

(12) United States Patent
Duzdar et al.

(10) Patent No.: US 7,164,385 B2
(45) Date of Patent: Jan. 16, 2007

(54) SINGLE-FEED MULTI-FREQUENCY MULTI-POLARIZATION ANTENNA

(75) Inventors: Ayman Duzdar, Holly, MI (US); Andreas D. Fuchs, Lake Orion, MI (US)

(73) Assignee: Receptec Holdings, LLC, Holly, MI (US)

( * ) Notice: Subject to any disclaimer, the term of this patent is extended or adjusted under 35 U.S.C. 154(b) by 0 days.

(21) Appl. No.: 11/145,878

(22) Filed: Jun. 6, 2005

(65) Prior Publication Data

US 2006/0273961 A1 Dec. 7, 2006

(51) Int. Cl.
*H01Q 1/38* (2006.01)

(52) U.S. Cl. ..... 343/700 MS; 343/853

(58) Field of Classification Search ..... 343/700 MS, 343/702, 853

See application file for complete search history.

(56) References Cited

U.S. PATENT DOCUMENTS 6,181,281 B1 * 1/2001 Desclos et al. ..... 343/700 MS
2004/0051675 A1 3/2004 Inoue
2004/0075610 A1 * 4/2004 Pan ..... 343/700 MS
2004/0183735 A1 * 9/2004 Jecko et al. ..... 343/700 MS
2006/0103576 A1 * 5/2006 Mahmoud et al. ... 343/700 MS

FOREIGN PATENT DOCUMENTS

EP 1357636 10/2003
JP 2000165135 6/2000

* cited by examiner

*Primary Examiner*—Hoang V. Nguyen
(74) *Attorney, Agent, or Firm*—Harness, Dickey & Pierce, P.L.C.

(57) ABSTRACT

An antenna capable of receiving both left-hand circularly polarized (LHCP) signals and right-hand circularly polarized (RHCP) signals, and outputting both signals on a single feed. The antenna includes two coplanar concentric patches. The inner patch is substantially square. The outer patch has inner and outer edges both of which are square. The two patches do not physically contact one another. A single feed is connected to the inner patch. The inner patch receives the LHCP signal, and the two patches together receive the RHCP signal.

3 Claims, 14 Drawing Sheets

SINGLE-FEED MULTI-FREQUENCY MULTI-POLARIZATION ANTENNA

BACKGROUND OF THE INVENTION

The present invention relates to antennas and more particularly to antennas for receiving signals of multiple frequencies and multiple polarizations.

In an increasingly wireless world, antennas are becoming ever more prevalent. This is particularly true in automobiles, which typically include antennas for one or more of AM radio, FM radio, satellite radio, cellular phones, and GPS. These signals are of different frequencies and polarizations. For example, the signals associated with satellite radio (e.g. brand names XM and Sirius) are in the range of 2.320 to 2.345 GHz and are left hand circularly polarized (LHCP); and the signals associated with global positioning systems (GPS) are in the range of 1.574 to 1.576 GHz and are right hand circularly polarized (RHCP).

Antenna packages have been developed in which multiple antennas receive and output multiple signals on multiple feeds. However, these packages are undesirably complex and expensive, and the multiple feeds are undesirable. While these prior art antenna packages have proven effective and popular, there is an ever increasing need for antennas of increasingly simple, compact, and low-cost design.

SUMMARY OF THE INVENTION

The aforementioned problems are overcome in the present invention in which a single antenna receives signals of multiple frequencies and multiple polarizations, and outputs those signals through a single feed.

In the disclosed embodiment, the antenna includes coplanar inner and outer patches. The outer patch surrounds the inner patch. The two patches are physically spaced from one another. A single feed is connected to the inner patch. The inner patch resonates at a first frequency with a first antenna polarization sense. The outer patch resonates at a second frequency with a second polarization sense. The first and second frequencies are different. The first and second antenna polarization senses can be the same or different. Both signals are outputted on the single feed.

In a further preferred embodiment, the two patches are metalized layers on a substrate.

The antenna of the present invention is relatively simple and inexpensive, yet highly effective and efficient. It enables signals of different frequencies and different polarizations to be outputted on a single feed.

These and other objects, advantages, and features of the invention will be more readily understood and appreciated by reference to the description of the current embodiment and the drawings.

DESCRIPTION OF THE CURRENT EMBODIMENT

Figure 1:
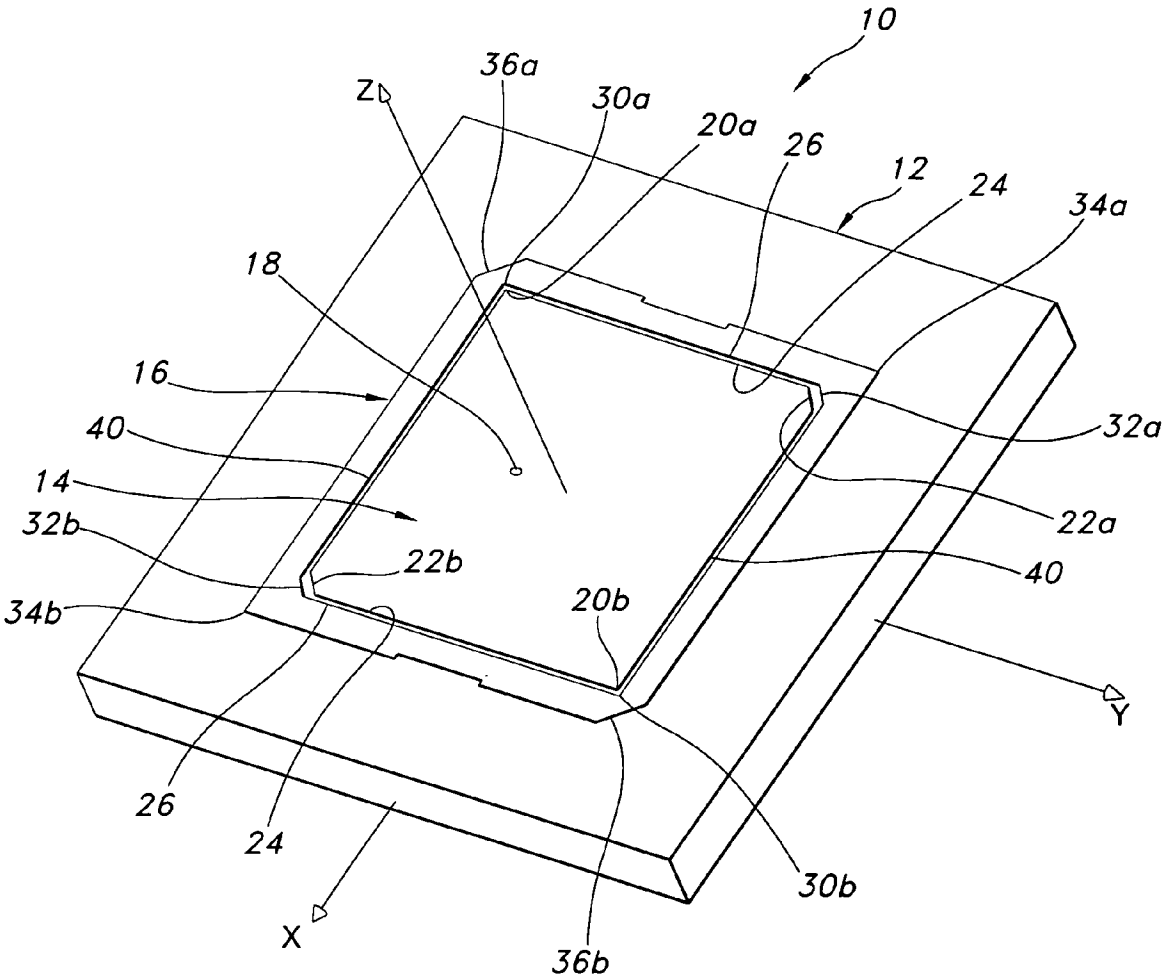
FIG. 1 is a top perspective view of the antenna.
Figure 2:
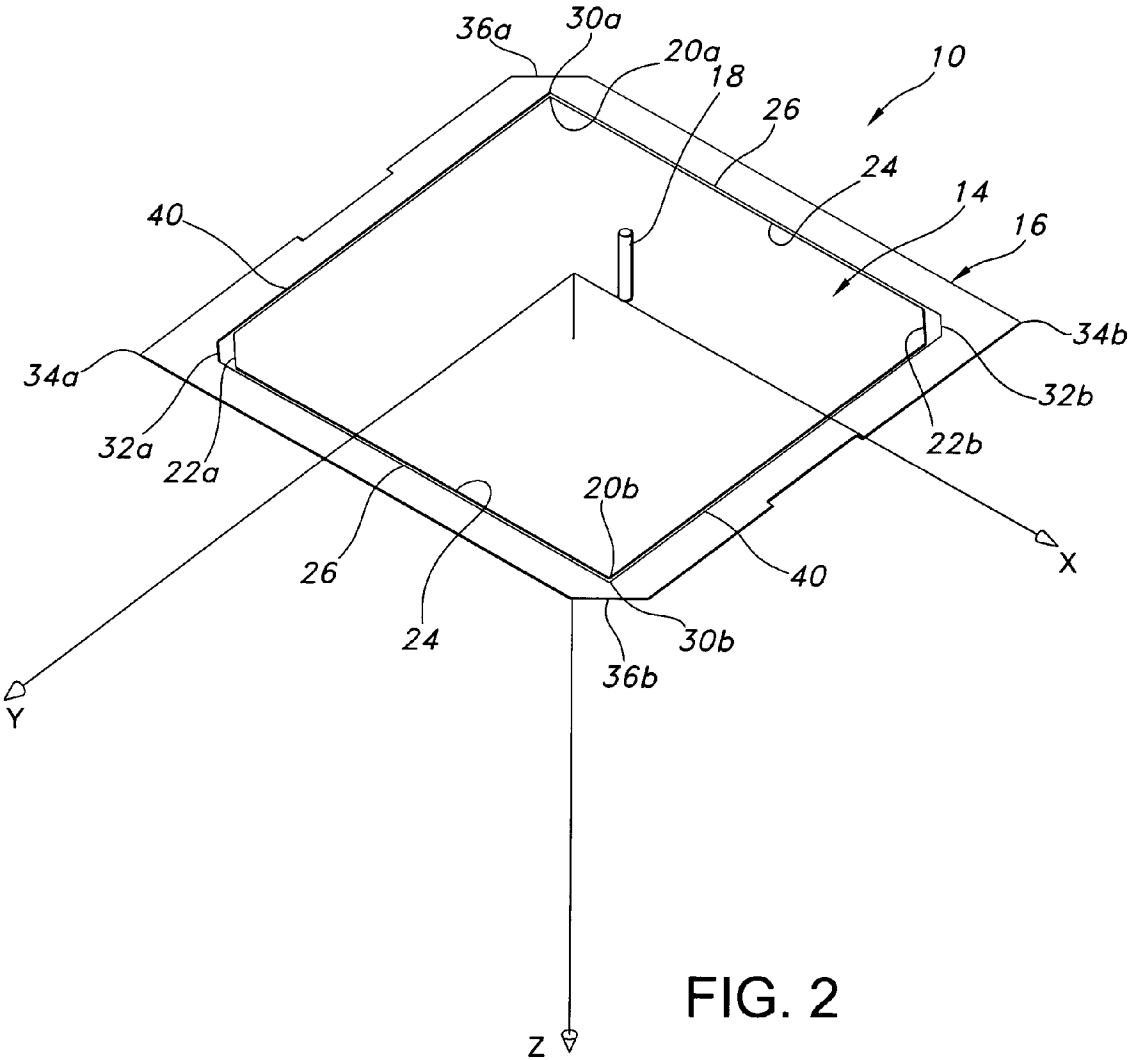
FIG. 2 is a bottom perspective view of the antenna but not showing the substrate.
Figure 3:
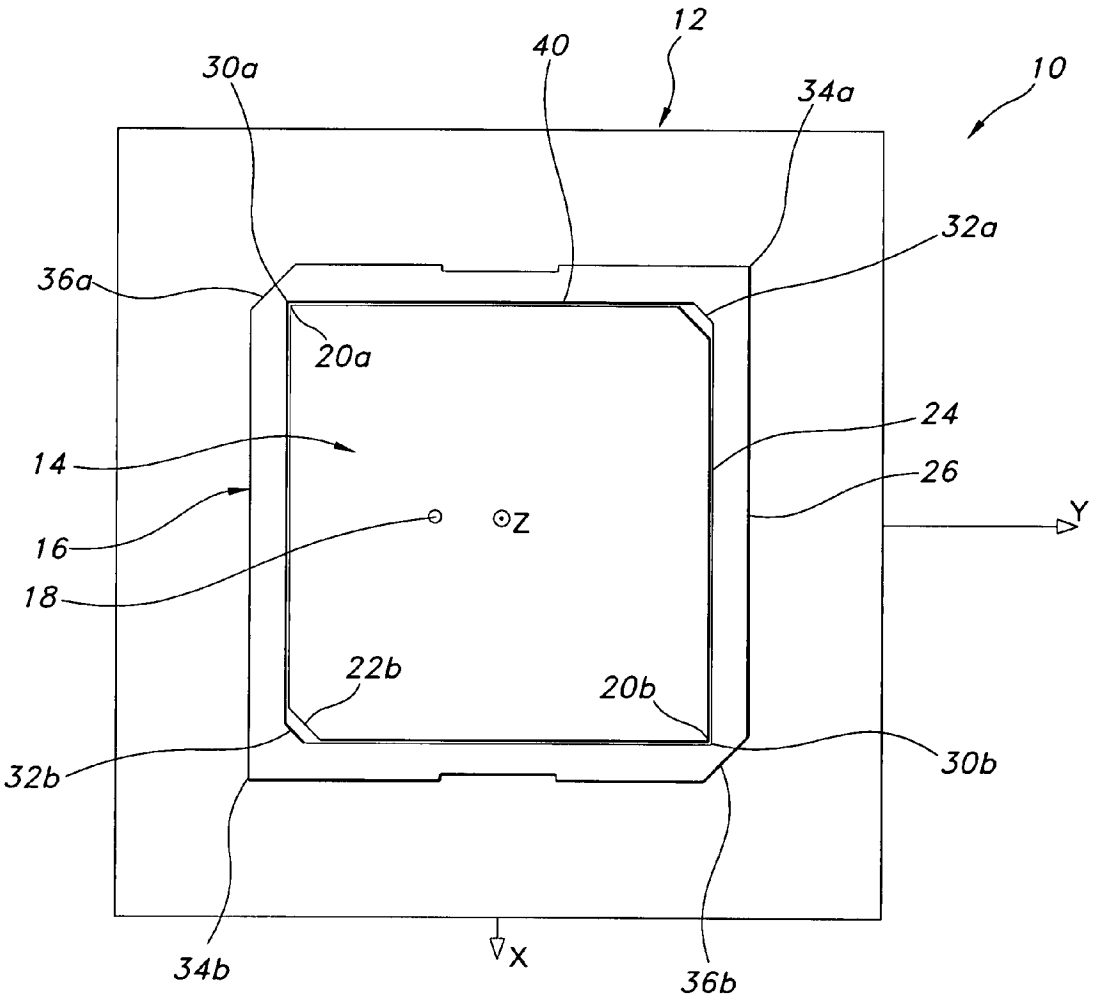
FIG. 3 is a top plan view of the antenna.

An antenna constructed in accordance with a current embodiment of the invention is illustrated in FIGS. 1–3 and generally designated 10. The antenna includes a substrate 12, an inner patch 14, an outer patch 16, and a single feed or lead 18. The inner and outer patches 14 and 16 are mounted on the substrate 12. The single feed 18 extends through the substrate 12 and is connected to the inner patch 14. The inner patch 14 receives a signals having a first frequency and a first polarization, and the inner and outer patches 14 and 16 together receive signals having a second frequency and a second polarization. The frequencies and polarizations are different. Both signals are outputted on the single feed 18.

The substrate 12 is well known to those skilled in the antenna art. The substrate can be fabricated of any suitable electrically nonconductive material such as plastic or ceramic. The substrate 12 supports the remaining elements of the antenna 10.

The directions X, Y, and Z are included in FIGS. 1–3 to provide clarity of orientation among the three views. The X and Y axes lie within the plane of the two coplanar patches 14 and 16. The Z axis is perpendicular to the plane of the patches, and extends through the center of the patches.

The inner patch 14 is substantially or generally square when viewed in plan view (see particularly FIG. 3). As a square, it has four corners 20*a*, 20*b*, 22*a*, and 22*b*. Two diagonally opposite corners 20*a* and 20*b* are substantially square, and the other two diagonally opposite corners 22*a* and 22*b* are substantially non-square as is conventional for antennas for circularly polarized signals. In the current embodiment, the corners 22*a* and 22*b* are cut at a 45° angle to the sides of the inner patch 14. Other appropriate techniques for non-squaring the corners 22*a* and 22*b* are and will be known to those skilled in the art.

The outer patch 16 is shaped like a picture frame about the inner patch 14. The outer frame 16 has a substantially square inner edge 24 and a substantially square outer edge 26. The two edges 24 and 26 are substantially concentric.

The inner edge 24 of the outer patch 16 is substantially square and includes four corners 30*a*, 30*b*, 32*a*, and 32*b*. Two diagonally opposite corners 30*a* and 30*b* are substantially square, and the other two diagonally opposite corners 32*a* and 32*b* are substantially not square. The non-square corners 32*a* and 32*b* are proximate or adjacent to the non-square corners 22*a* and 22*b* on the inner patch 14.

The outer edge 26 of the outer patch 16 also is substantially square and includes four corners 34*a*, 34*b*, 36*a*, and 36*b*. Two diagonally opposed corners 34*a* and 34*b* are substantially square, and the other two diagonally opposed corners 36*a* and 36*b* are substantially not square. The non-square corners 36*a* and 36*b* are remote from the non-square corners 22*a* and 22*b* of the inner patch 14. Like the non-square corners of the inner patch, the non-square corners 32*a*, 32*b*, 36*a*, and 36*b* are angled at 45° relative to the sides of the square inner edge 24. Other appropriate shapes are and will be known to those skilled in the art.

The inner edge 24 of the outer patch 16 is spaced from the inner patch 14. Additionally, the two patches 14 and 16 are positioned concentrically about a common center axis Z. Therefore, the patches 14 and 16 define a gap 40 therebetween so that the patches 14 and 16 are physically separate from one another. The width of the gap is substantially uniform about the perimeter of the inner patch 14. The gap widens in the areas of the corners 22*a*, 22*b*, 32*a*, and 32*b*.

In the current embodiment, the patches 14 and 16 are metalized layers formed directly on the substrate 12. Each patch is substantially planar; and the two patches are substantially coplanar.

The relative size, shape, and orientations of the patches 14 and 16 can be tuned through a trial-and-error process. The patches 14 and 16 shown in the drawings illustrate the current embodiment, which has been tuned to provide a balance among the performance factors. Those skilled in the art will recognize that the patches can be tuned differently to achieve different balances among the performance factors.

The single feed 18 is connected only to the inner patch 14. The feed 18 extends through the substrate 12. The feed 18 is connected off center of the inner patch 14 as is conventional for antennas for circularly polarized signals.

OPERATION

The antenna 10 outputs two different signals having different frequencies and different polarizations on the single feed 18. The inner patch 14 operates independently to receive left hand circularly polarized (LHCP) signals for example those associated with satellite radio. The patches 14 and 16 together operate to receive right hand circularly polarized (RHCP) signals for example those associated with GPS signals.

Figure 4:
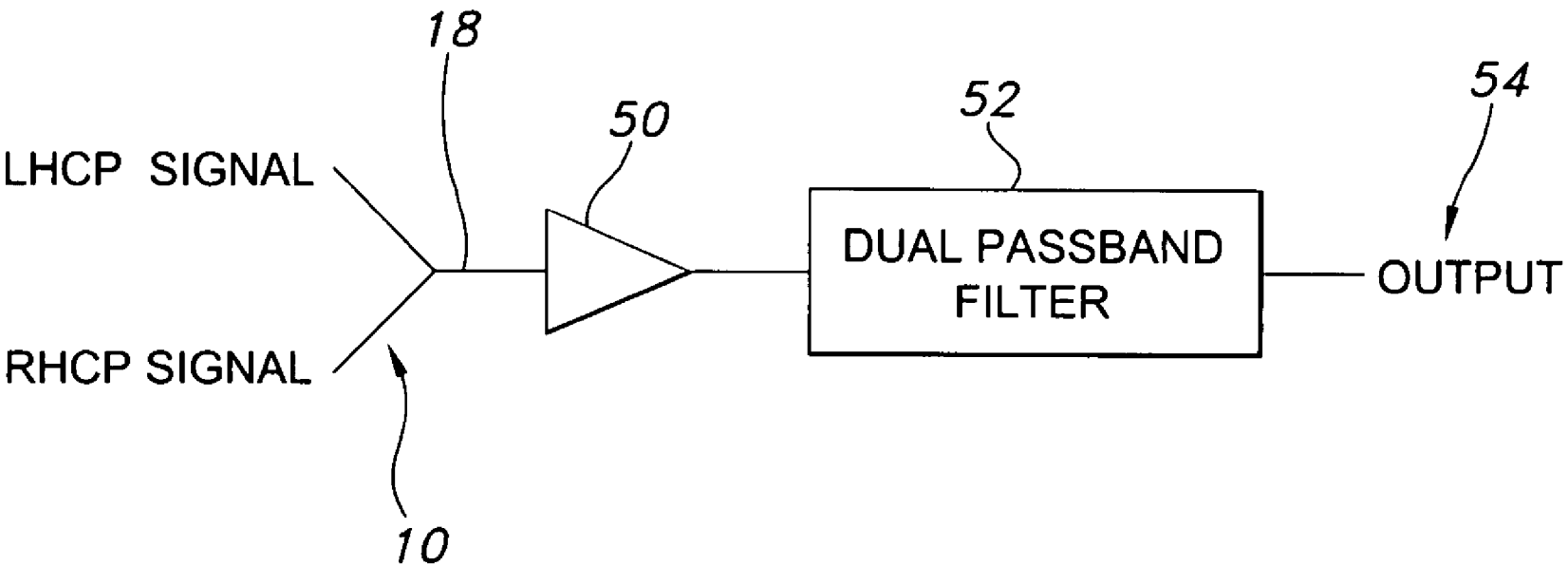
FIG. 4 is a schematic diagram of the antenna and the signal processing components contemplated for attachment thereto.

FIG. 4 is a schematic diagram showing the antenna 10 connected to an amplifier 50 and a dual passband filter 52. The amplifier 50 can be of any suitable design known to those skilled in the art. Similarly, the dual passband filter 52 can be of any suitable design known to those skilled in the art. When the antenna 10 is for satellite radio signals and GPS signals, the two passbands are in the range of 2.320 to 2.345 GHz for the satellite radio signal, and in the range of 1.574 to 1.576 GHz for the GPS signal. The output 54 of the dual passband filter 52 may be fed to a satellite radio receiver and/or a GPS unit.

Figure 5:
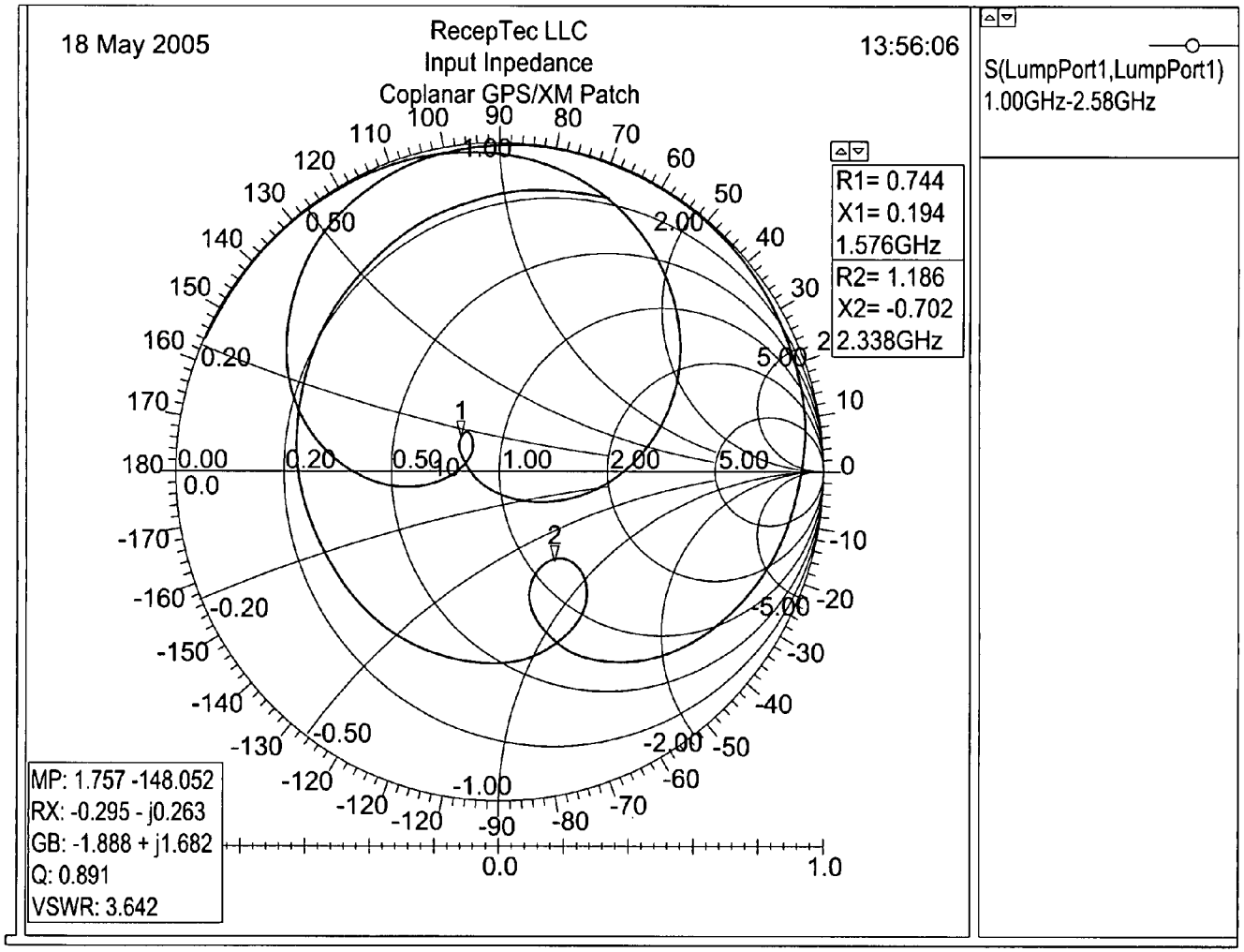
FIGS. 5–14 are plots and charts illustrating the performance of the antenna.

FIGS. 5–14 are plots and charts illustrating the performance of the antenna of the current embodiment. FIG. 5 is a Smith chart showing the impedance of the coplanar patches. This charts shows that the coplanar patches have a dual resonance with a circularly polarized sense at each resonance. (One cannot tell what the polarization sense is from the impedance, but can tell if it is circular or linear.) The markers R1, X1 and R2, X2 represent the real and imaginary impedance parts at the GPS and XM bands, respectively. The impedance values are normalized with respect to 50 ohms.

Figure 6:
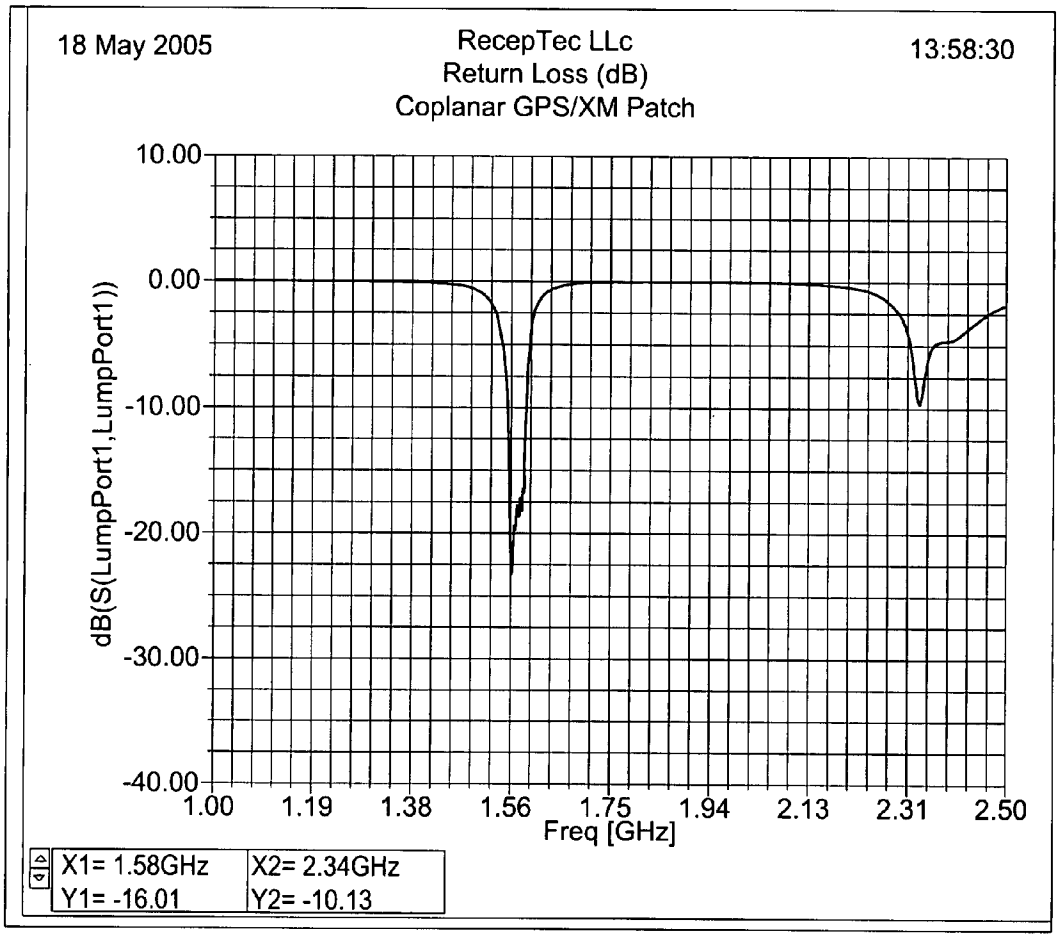

FIG. 6 illustrates the return loss of the coplanar patches in dB. The plot shows that at both resonance frequencies the antenna can be matched well (greater than 10 dB in return loss) for practical applications. The markers X1, Y1 and X2, Y2 represent the frequency of resonance and the return loss in dB, respectively.

Figure 7:
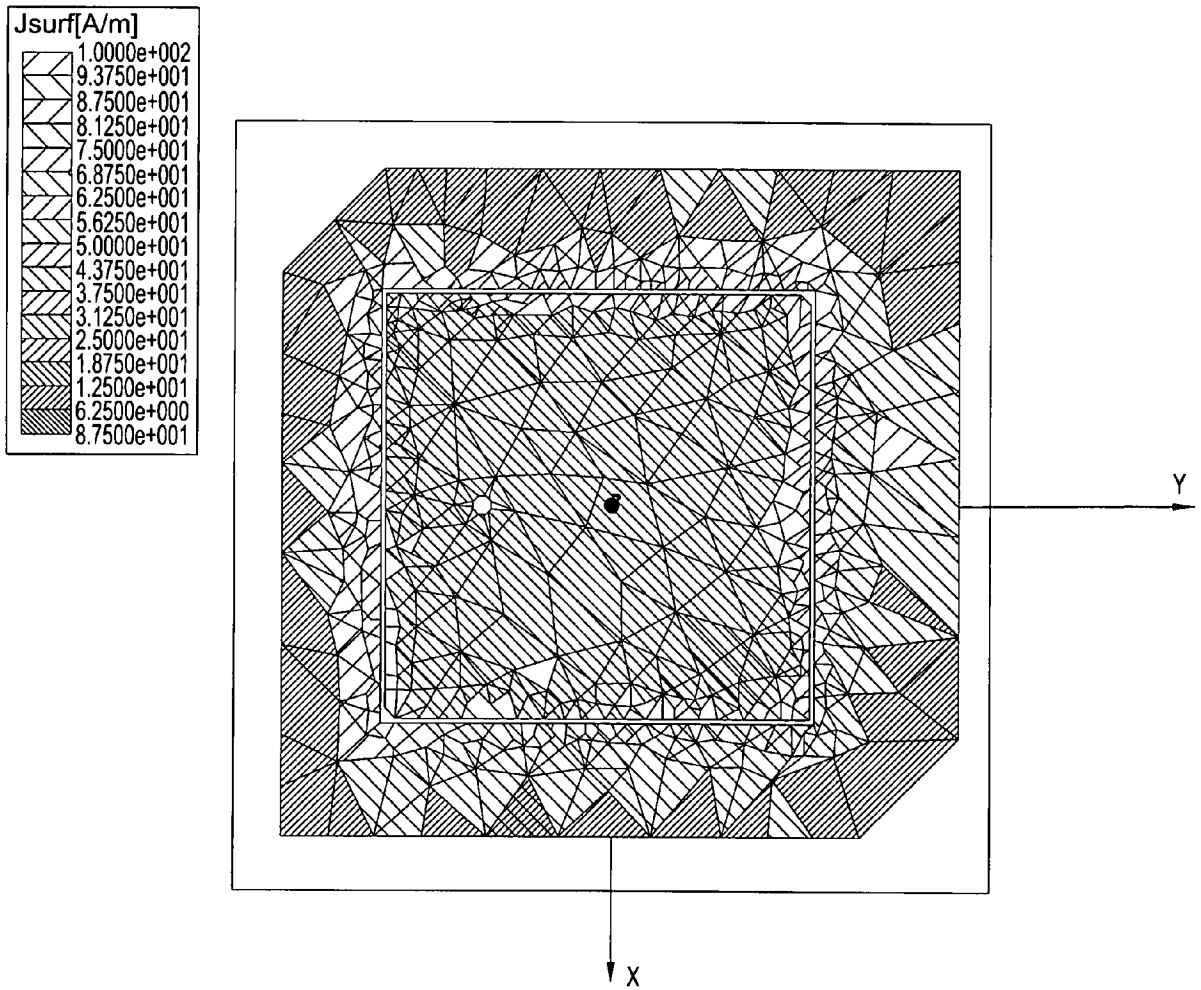

FIG. 7 is an illustration of the surface RF current distribution on the metallization of the coplanar patches in the XM frequency range. White corresponds to maximum surface current, while black is corresponds to minimum surface current. The resonating structure is the inner patch with the chamfered corners being the 'hot spots,' where the illustration indicates that the current distribution gives a LHCP radiation based on the probe location with respect to the chamfered edges. In addition, the outer patch is not resonating as evidenced by the fact that the surface current distribution on it is minimal.

Figure 8:
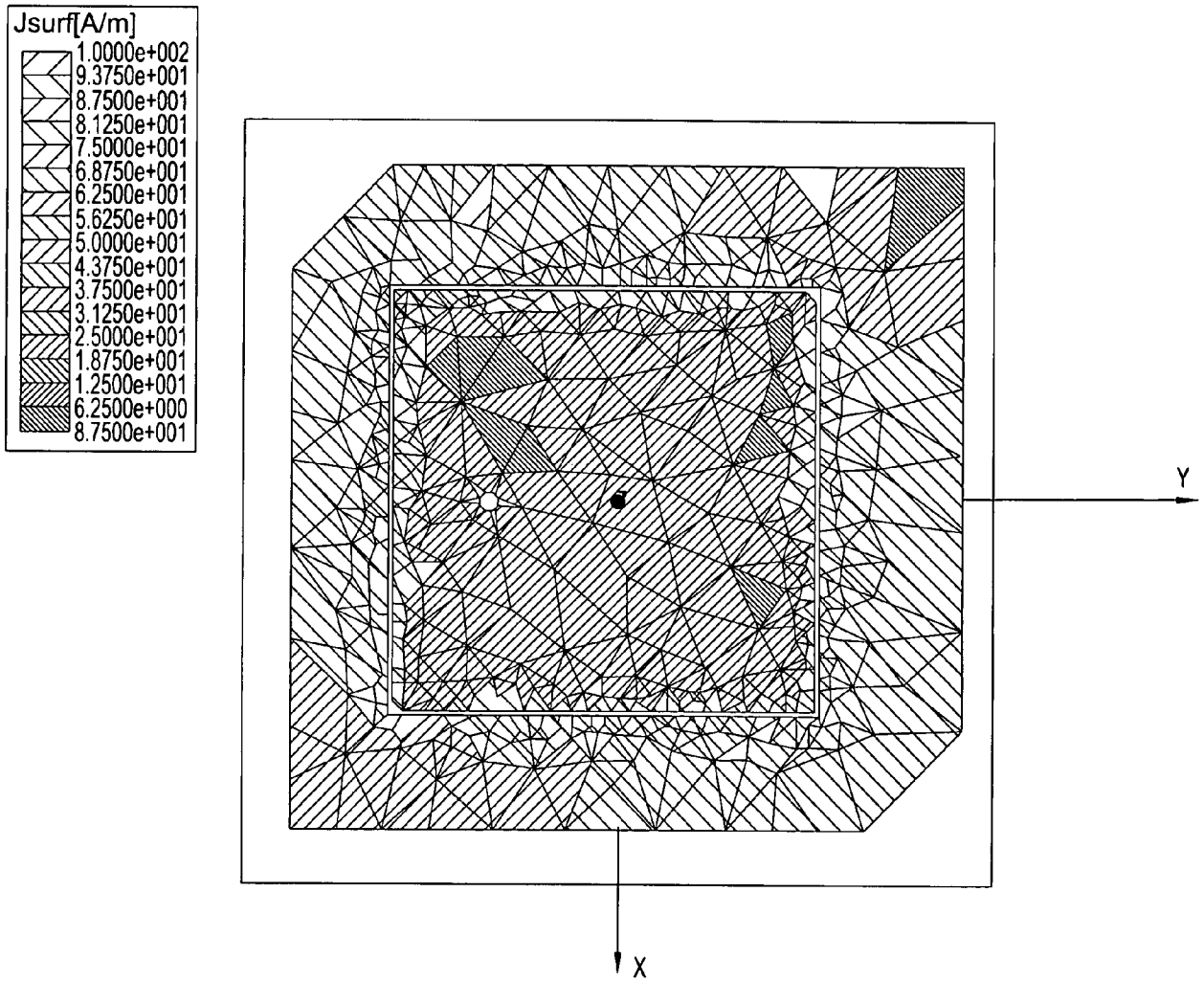

FIG. 8 is an illustration of the surface RF current distribution on the metallization of the coplanar patches in the GPS frequency range. Again, white corresponds to maximum surface current, while black is corresponds to minimum surface current. The resonating structure is the outer patch with the chamfered corners being the 'hot spots,' where the illustration indicates that the current distribution gives a RHCP radiation based on the probe location with respect to the chamfered edges. In addition, the inner patch is not resonating as evidenced by the fact that the surface current distribution on it is minimal.

Figure 9:
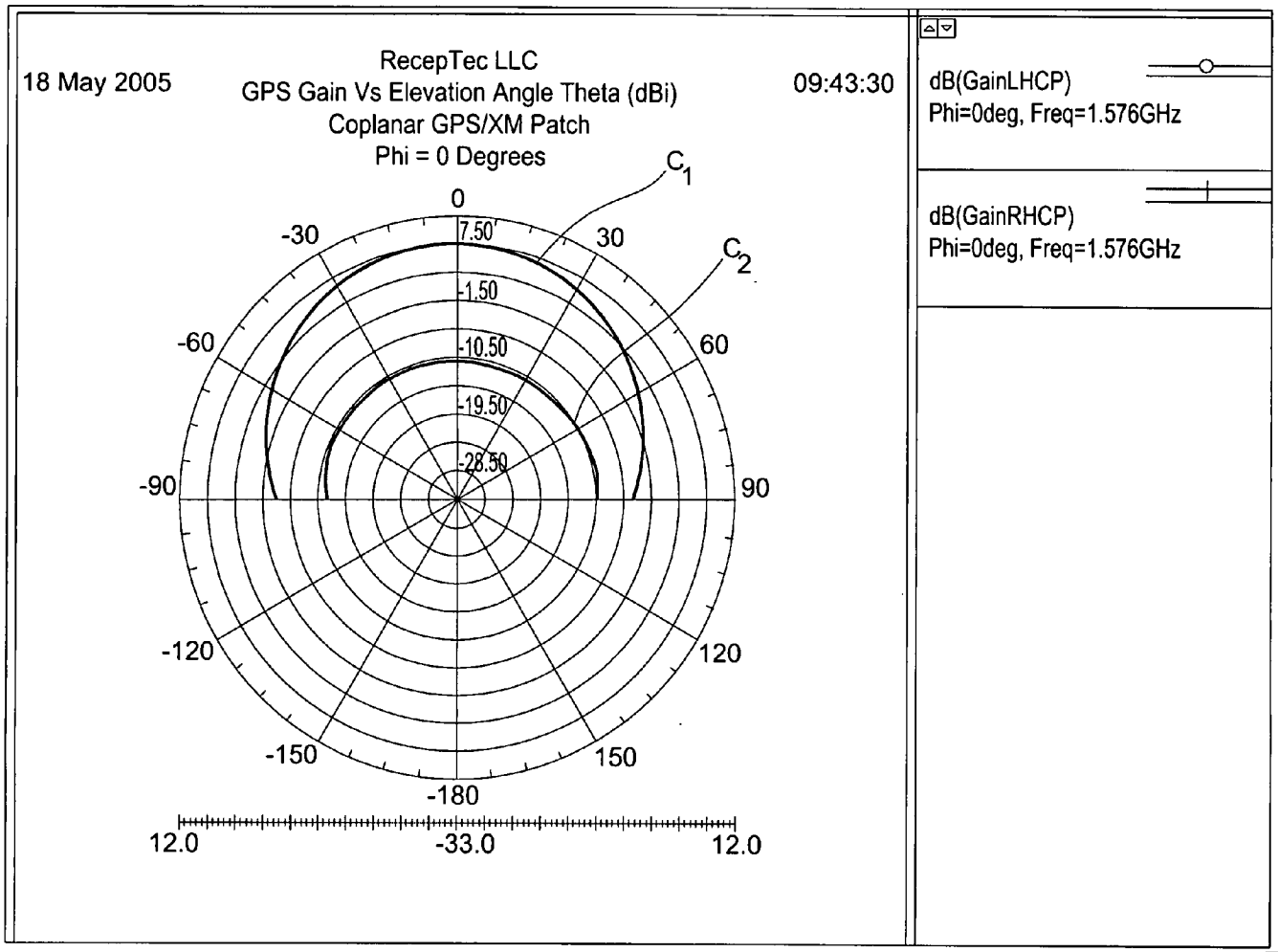

FIG. 9 shows the coplanar patch radiation pattern in the GPS frequency range. Gain is shown in dBic (antenna gain, decibels referenced to a circularly polarized, theoretical isotropic radiator). The curve C1 is RHCP, named the co-polarization of the antenna, while the curve C2 is the LHCP, named the cross-polarization of the antenna. The RHCP is much higher in amplitude than the LHCP. This radiation pattern cut is called gain as a function of the elevation angle theta (θ), which in spherical coordinates is measured for the positive z-axis shown in FIG. 2. Maximum gain occurs at theta=0 degrees, which is also called the boresight of the antenna. This is a typical radiation pattern for a patch antenna. In addition, this particular cut is at azimuth angle phi (ϕ) at 0 degrees. Phi is measured from the positive x-axis shown in FIG. 2.

Figure 10:
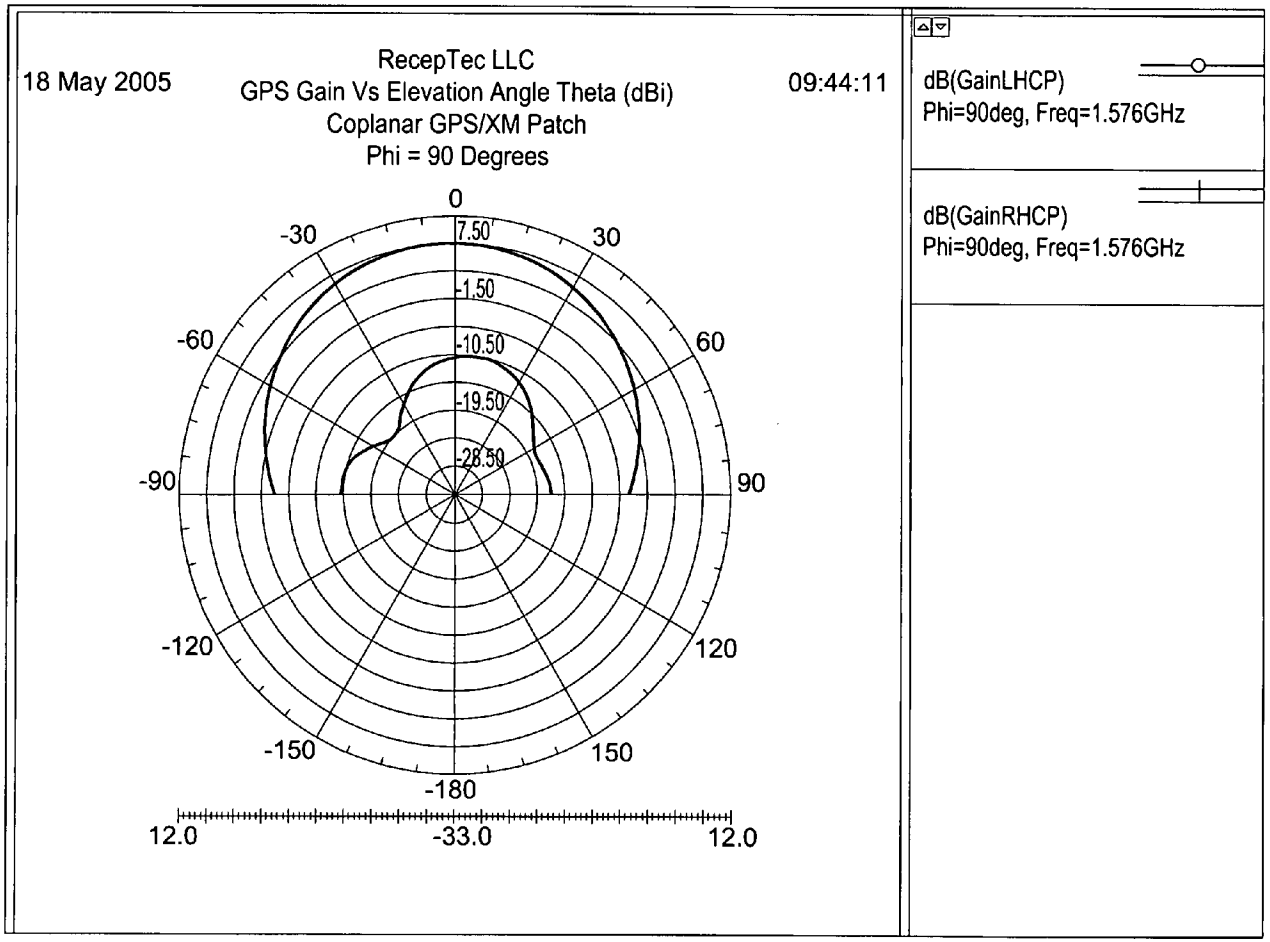

FIG. 10 is similar to FIG. 9, except that the azimuth angle phi=90 degrees. The maximum co-polarization RHCP occurs at the boresight of the antenna.

Figure 11:
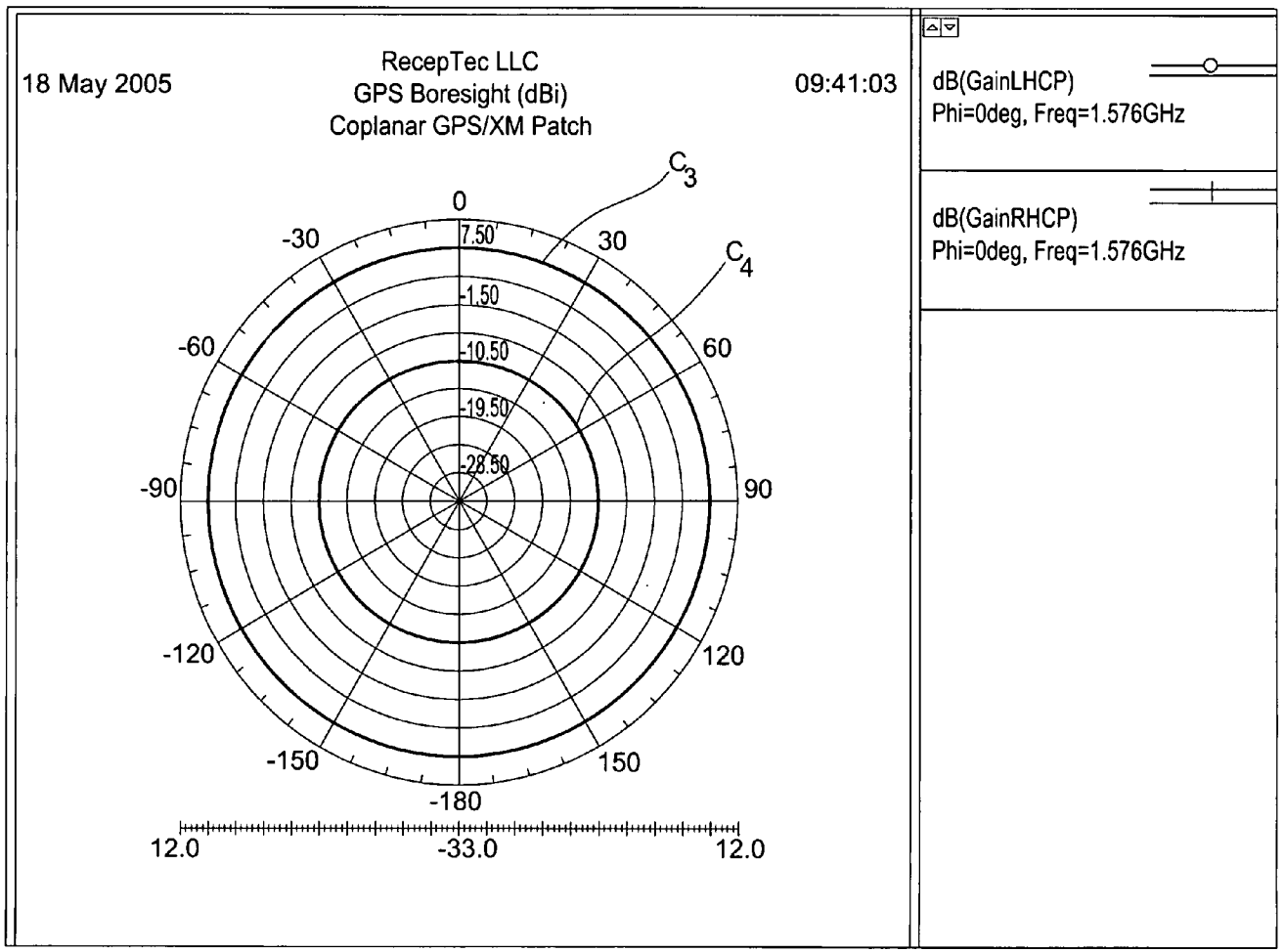

FIG. 11 shows gain as a function of the azimuth angle phi at elevation angle theta=0 (i.e. at the boresight) in the GPS frequency range. The curve C3 is RHCP, and the curve C4 is LHCP. The RHCP (co-polarization) is at least 17.5 dB higher than the LHCP (cross-polarization), suggesting that the antenna at the GPS frequency range is right-hand circularly polarized.

Figure 12:
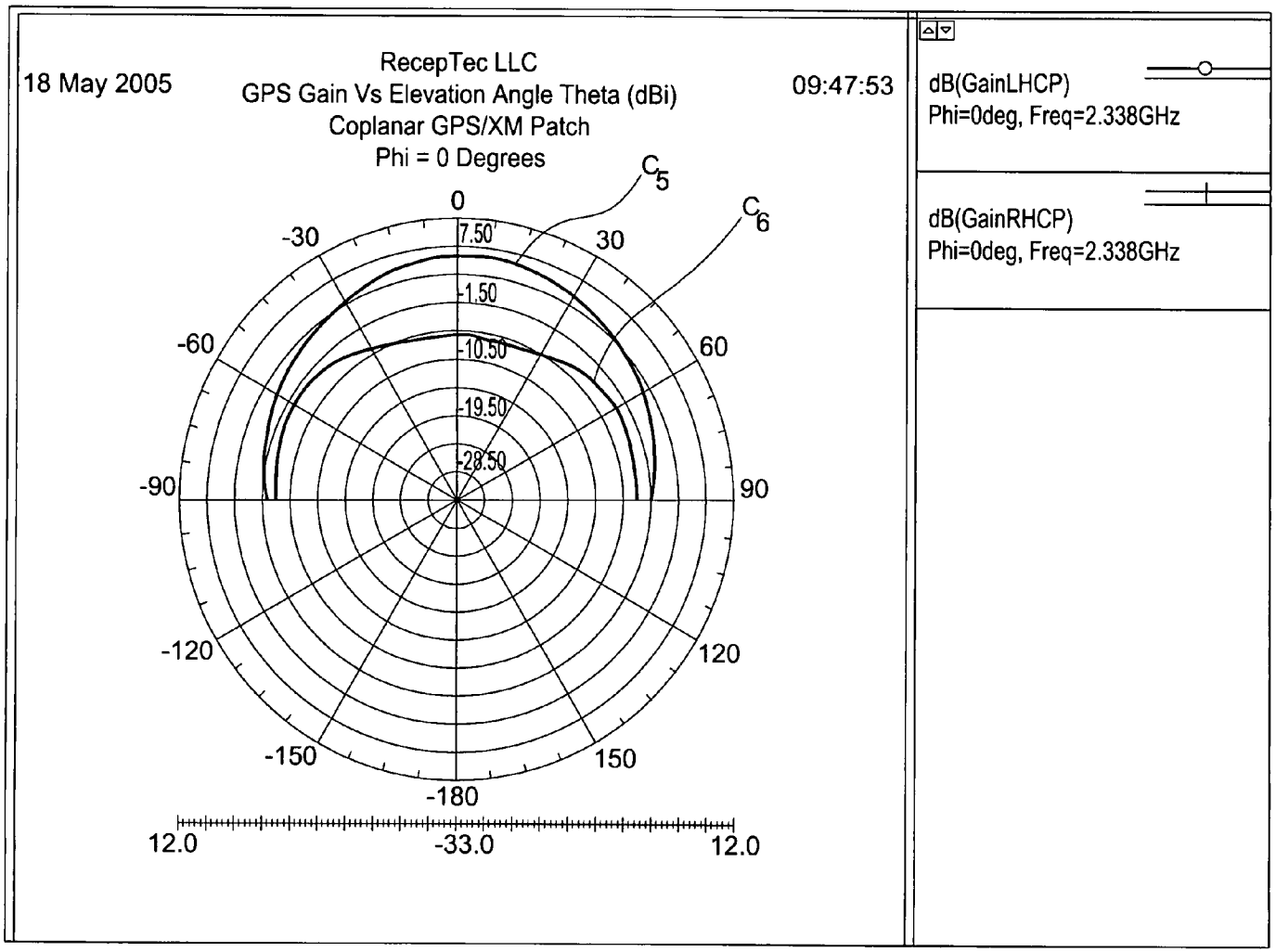

FIG. 12 shows radiation pattern (gain in dBic) in the XM frequency range. The curve C5 is LHCP, named the co-polarization of the antenna, while the curve C6 is the RHCP, named the cross-polarization of the antenna. The LHCP is much higher in amplitude than the RHCP. This radiation pattern cut is again called "gain as a function of the elevation angle theta (θ)". Maximum gain occurs at theta=0 degrees, which is also the boresight of the antenna. Again, this is a typical radiation pattern of a patch antenna. In addition, this cut is at azimuth angle phi (ϕ) at 0 degrees.

Figure 13:
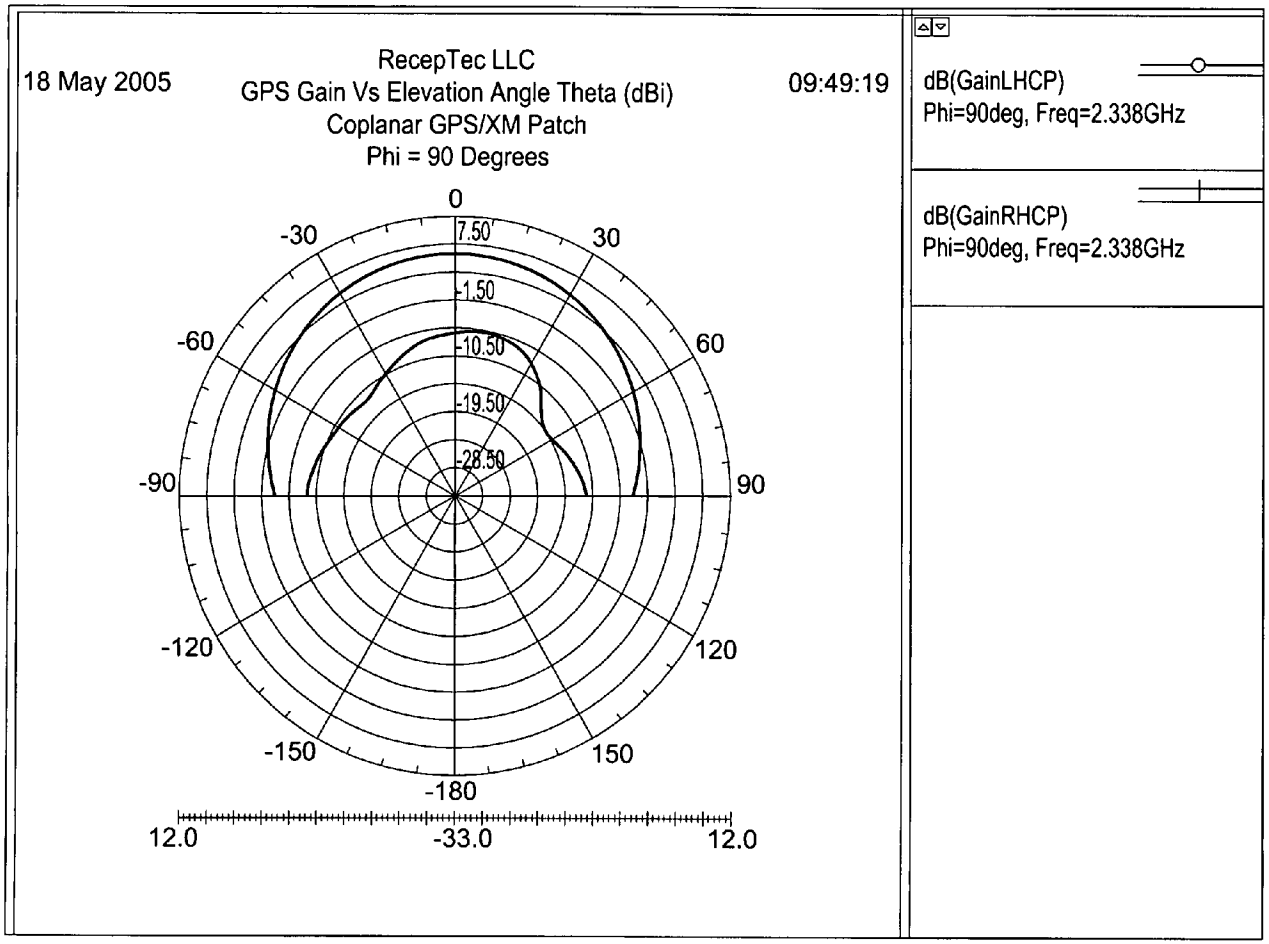

FIG. 13 is similar to FIG. 12, except that the azimuth angle phi=90 degrees. The maximum co-polarization LHCP occurs at the boresight of the antenna.

Figure 14:
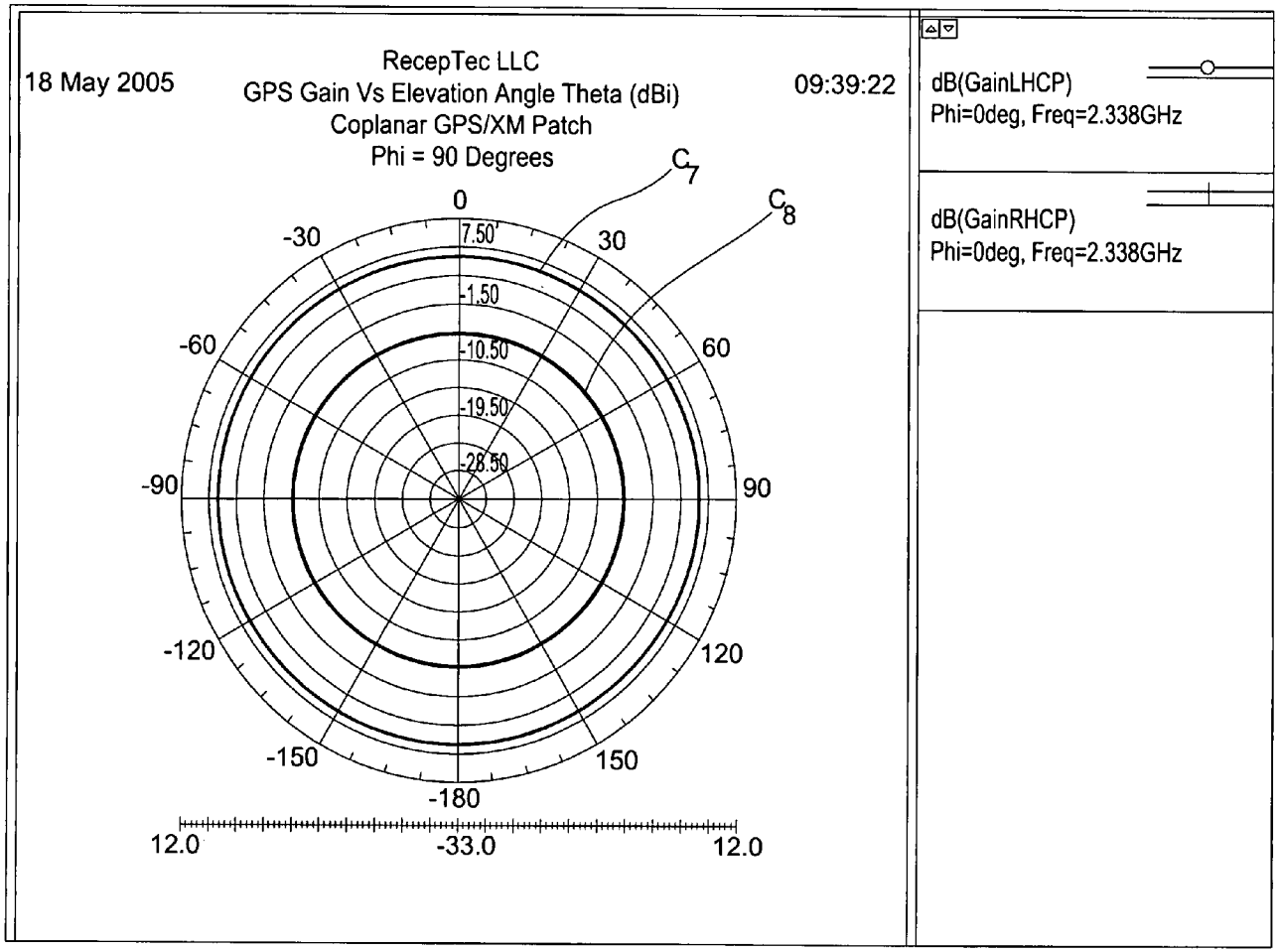

FIG. 14 shows gain as a function of the azimuth angle phi at elevation angle theta=0 (i.e. at boresight) in the XM frequency range. The curve C7 is LHCP, and the curve C8 is LHCP. The LHCP (co-polarization) is at least 13 dB higher than the RHCP (cross-polarization), suggesting that the antenna is left-hand circularly polarized.

The above description is that of a current embodiment of the invention. Various alterations and changes can be made without departing from the spirit and broader aspects of the invention as defined in the appended claims, which are to be interpreted in accordance with the principles of patent law including the doctrine of equivalents.

The invention claimed is:

1. An antenna comprising:

a first substantially planar antenna element being substantially square and having four corners, two of said corners diagonally opposite one another being non-square;

a second substantially planar antenna element substantially coplanar with and surrounding said first antenna element, said second antenna element having an inner edge and an outer edge each being substantially square and having four corners, said inner and outer edges being substantially concentric, two of said corners on each of said inner and outer edges diagonally opposite one another being non-square, said two corners of said inner edge being adjacent said two corners of said first antenna element, said two corners of said outer edge being remote from said two corners of said first antenna; and a feed physically connected only to said first antenna element, said second antenna element not having a feed.

2. An antenna element as defined in claim 1 wherein said first and second antenna elements do not physically contact each other.

3. An antenna element as defined in claim 1 wherein said first antenna element and said inner edge of said second antenna element define a gap having a substantially uniform width.

* * * * *